United States Patent [19]

Meschter et al.

[11] Patent Number: 4,861,551

[45] Date of Patent: Aug. 29, 1989

[54] ELEVATED TEMPERATURE ALUMINUM ALLOYS

[75] Inventors: Peter Meschter, Florissant; Richard J. Lederich, U. City; James E. O'Neal, Bridgeton, all of Mo.

[73] Assignee: The United States of America as represented by the Administrator, National Aeronautics and Space Administration, Washington, D.C.

[21] Appl. No.: 79,316

[22] Filed: Jul. 30, 1987

[51] Int. Cl.[4] ..... C22C 21/00

[52] U.S. Cl. ..... 420/533; 420/535

[58] Field of Search ..... 420/533, 535; 148/439, 148/440

[56] References Cited

U.S. PATENT DOCUMENTS

| | | | |
|---|---|---|---|
| 1,305,551 | 8/1918 | Kirk | 420/538 |
| 1,870,732 | 1/1931 | Iytaka | 420/542 |
| 4,094,705 | 6/1978 | Sperry et al. | 148/2 |
| 4,193,822 | 3/1980 | Adam et al. | 148/3 |
| 4,477,292 | 10/1984 | Brown | 148/417 |
| 4,588,553 | 5/1986 | Evans et al. | 420/533 |

*Primary Examiner*—R. Dean

*Attorney, Agent, or Firm*—George F. Helfrich; John R. Manning; Charles E. B. Glenn

[57] ABSTRACT

Three aluminum-lithium alloys are provided for high performance aircraft structures and engines. All three alloys contain 3 wt % copper, 2 wt % lithium, 1 wt % magnesium, and 0.2 wt % zirconium. Alloy 1 has no further alloying elements. Alloy 2 has the addition of 1 wt % iron and 1 wt % nickel. Alloy 3 has the addition of 1.6 wt % chronium to the shared alloy composition of the three alloys. The balance of the three alloys, except for incidentql impurities, is aluminum. These alloys have low densities and improved strengths at temperatures up to 260° C. for long periods of time.

6 Claims, 3 Drawing Sheets

ELEVATED TEMPERATURE ALUMINUM ALLOYS

ORIGIN OF THE INVENTION

The invention described herein was made in performance of work under a NASA Contract and is subject to the provisions of Section 305 of the National Aeronautics and Space Act of 1958, Public Law 85-568 (72 Stat. 435, 42 USC 2457).

TECHNICAL FIELD OF THE INVENTION

This invention relates to aluminum-lithium alloys and more particularly to aluminum-lithium alloys suitable for high performance aircraft structures and engines.

BACKGROUND OF THE INVENTION

High performance aircraft structures and engines are often utilized at elevated temperature conditions approaching 260° C. Titanium, aluminum, and aluminum-lithium alloys are currently used under these conditions. Titanium alloys such as Ti-6Al-4V have desirably high strengths but have undesirably high densities. Aluminum alloys, on the other hand, have desirably low densities, but have undesirably low strengths and an undesirably severe loss of strength at temperatures above 150° C. Aluminum-lithium alloys do have an attractive combination of very low density and high ambient temperature strength. However, previous work on aluminum-lithium alloys produced by conventional and rapid solidification processes has shown significant degradation in strength when exposed to temperatures above 75° C. for periods greater than one hour.

Accordingly, it is an object of this invention to provide aluminum-lithium alloys which have the desirable combination of low density and high strength.

It is a further object of this invention to obtain the above object at operating temperatures ranging from 25° C. to 260° C.

It is a further object of this invention to accomplish the above objects for increased operational periods.

Other objects and advantages of this invention will become apparent hereinafter the specification and drawings which follow.

SUMMARY OF THE INVENTION

According to the present invention, the foregoing and additional and objects are obtained by providing three aluminum-lithium alloys, all three of which alloys contain 3 wt % copper, 2 wt % lithium, 1 wt % magnesium, and 0.2 wt % zirconium. Alloy 1 has no further alloying elements. Alloy 2 has, in addition, 1 wt % iron and 1 wt % nickel. Alloy 3 has, in addition, 1.6 wt % chromium in the shared alloy composition of the three alloys. The balance of the three alloys, except for incidental impurities, is aluminum. These alloys have low densities and improved strengths at temperatures up to 260° C. for long periods of time.

DETAILED DESCRIPTION OF THE INVENTION

Figure 1:
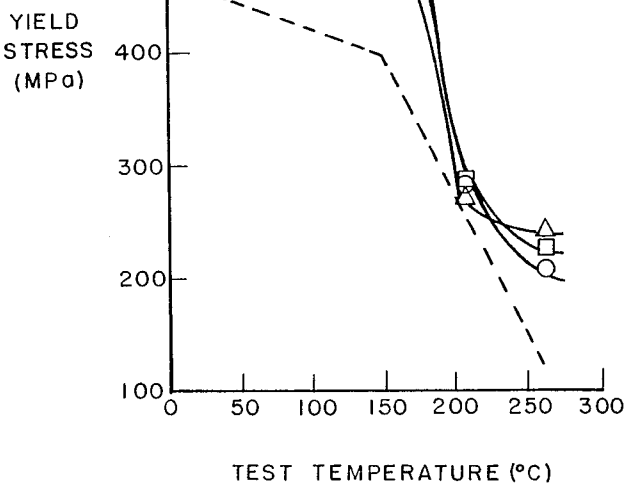
FIG. 1 is a graph of the yield stress versus temperature for the three alloys of the present invention of a T6 temper (solution treated, quenched and aged) and a standard aluminum alloy after a one hundred hour exposure.

Three aluminum-lithium alloys are provided which have low densities and high strengths at temperatures ranging from 25° C. to 260° C. for periods of time up to 100 hours. All three alloys contain 3 wt % copper (Cu), 2 wt % lithium (Li), 1 wt % magnesium (Mg), and 0.2 wt % zirconium (Zr).

Referring now to Table I, the composition of alloy 1 is represented. Alloy 1 has no further alloying elements. The balance of alloy 1, except for incidental impurities, is aluminum (Al).

TABLE I

| Element | Wt % |
|---|---|
| Cu | 3.0 |
| Li | 2.0 |
| Mg | 1.0 |
| Zr | 0.2 |
| Al | Balance (except for incidental impurities) |

Referring now to Table II, the composition of alloy 2 is represented. Alloy 2 has the addition of 1 wt % iron (Fe) and 1 wt % nickel (Ni) to the shared alloy composition of the three alloys according to the present invention. The balance of alloy 2, except for incidental impurities, is Al.

TABLE II

| Element | Wt % |
|---|---|
| Cu | 3.0 |
| Li | 2.0 |
| Mg | 1.0 |
| Zr | 0.2 |
| Fe | 1.0 |
| Ni | 1.0 |
| Al | Balance (except for incidental impurities) |

Referring now to Table III, the composition of alloy 3 is represented. Alloy 3 has the addition of 1.6 wt % chromium (Cr) to the shared alloy composition of the three alloys according to the present invention. The balance of alloy 3, except for incidental impurities, is Al.

TABLE III

| Element | Wt % |
|---|---|
| Cu | 3.0 |
| Li | 2.0 |
| Mg | 1.0 |
| Zr | 0.2 |
| Cr | 1.6 |
| Al | Balance (except for incidental impurities) |

Powders of the three alloys were produced by inert gas atomization at solidification rates in excess of $10^{3°}$ K./s. The powders were then consolidated by cold-pressing, canning, vacuum degassing, vacuum hot-pressing, and hot extrusion. This rapid solidification processing allowed segregationless incorporation of the soluble elements Cu, Li, and Mg. These soluble elements were added to the aluminum to produce precipitates such as $\delta^1$ ($Al_3Li$), $T_1$($Al_2LiCu$), and S' ($Al_2CuMg$) in solution treated and aged alloys. These precipitates resisted coarsening and provide large strength increments after long-time exposure up to 150° C. Also, this rapid solification process with the addition of either 1 wt % Fe and 1 wt % Ni as in alloy 2 or 1.6 wt % Cr as in alloy 3 allowed for the production of $Al_9FeNi$ or $Al_{18}Cr_2Mg_3$ incoherent dispersoids of sufficiently small diameter and homogeneous distribution. These dispersoids yielded a substantial amount of additional elevated temperature strength and are primarily responsible for the improved strength at 260° C.

Figure 2:
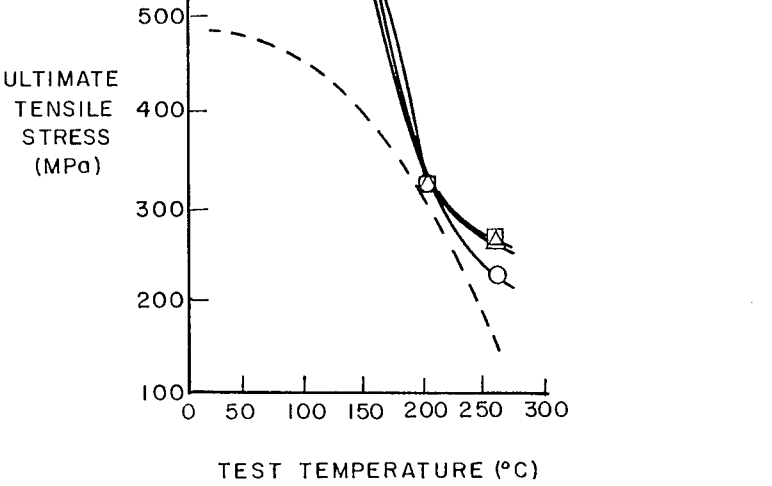
FIG. 2 is a graph of the ultimate tensile strength versus temperature for the three alloys of the present invention of a T6 temper and a standard aluminum alloy after a one hundred hour exposure.
Figure 3:
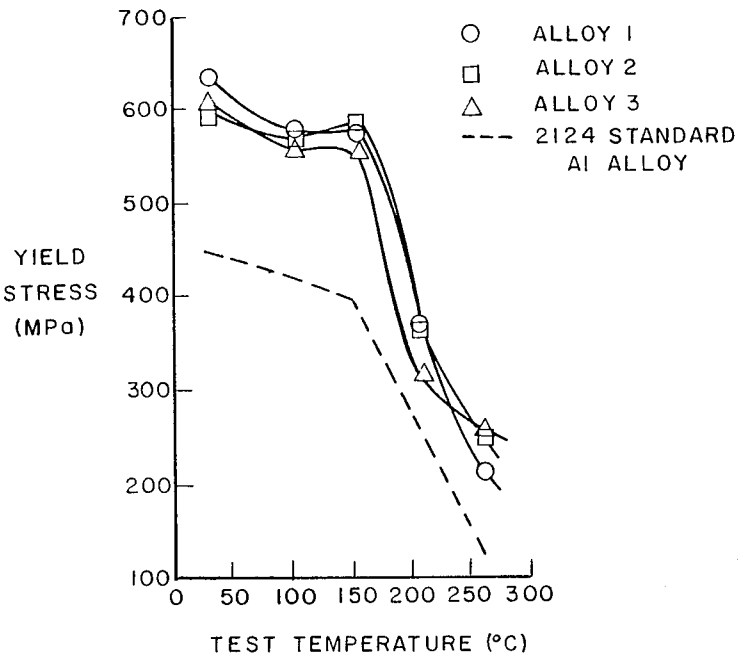
FIG. 3 is a graph of the yield stress versus temperature for the three alloys of the present invention of a T8 temper (solution treated, quenched, stretched, and aged) and a standard aluminum alloy after a one hundred hour exposure.
Figure 4:
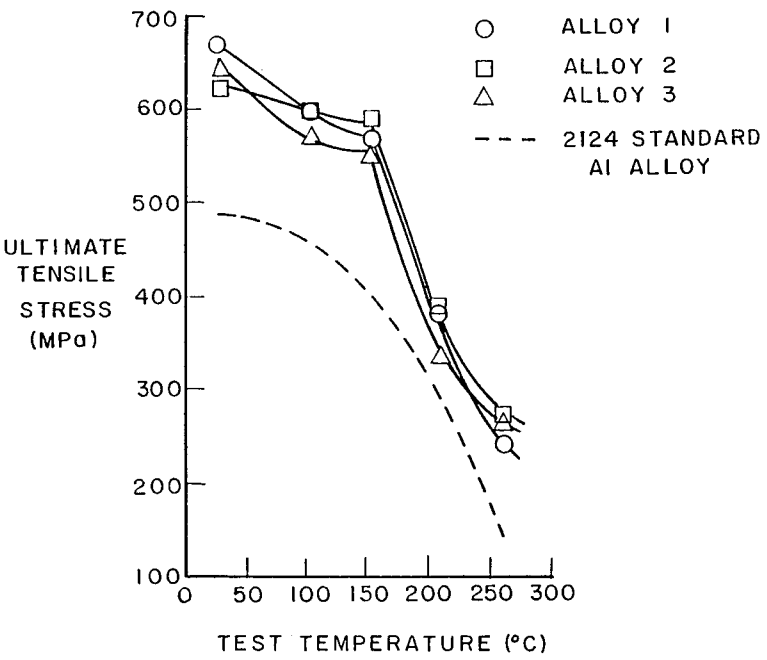
FIG. 4 is a graph of ultimate tensile strength versus temperature for the three alloys of the present invention of a T8 temper and a standard aluminum alloy after a hundred hour exposure.

Referring now to FIGS. 1–4, the yield stresses and the ultimate tensile strengths of the three alloys of the present invention and of a standard 2124 aluminum alloy are shown at various temperatures. Each datum point was obtained after exposure of a sample to the particular temperature for 100 hours. In FIGS. 1 and 2, the three alloys are of a T-6 temper (solution treated, quenched, and aged). In FIGS. 3 and 4, the three alloys are of a T-8 temper (solution treated, quenched, stretched, and aged). Referring now to FIGS. 1 and 3, the three alloys of the present invention have a significantly higher yield stress than the standard aluminum alloy.

For example, referring now to FIG. 3, at 150° C. alloy 2 has an increase of 200 MPa over the standard aluminum alloy. Referring now to FIG. 4, at 150° C. alloy 3 has an increase of 190 MPa over the standard aluminum alloy. Referring now to FIGS. 1–4, at 260° C. all three alloys of the present invention have yield and ultimate tensile strengths greater than the standard aluminum alloy.

It should be also noted that all three alloys of the present invention have similar yield and ultimate tensile stresses up to 150° C. From 150° C. to 260° C., alloys 2 and 3 have higher yield and ultimate tensile strengths resulting from the dispersion strengthening discussed above.

Figure 5:
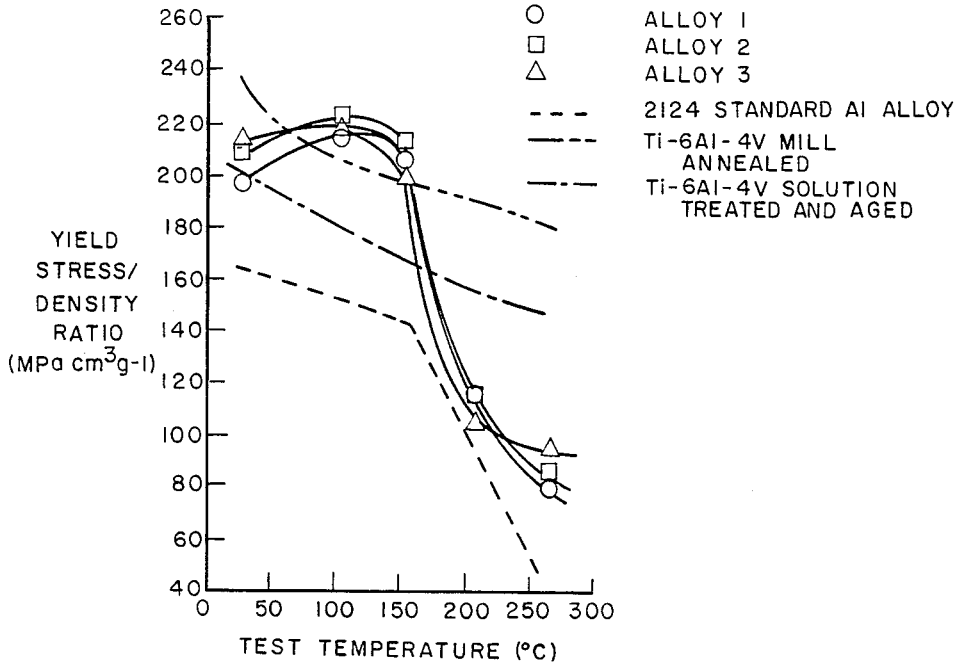
FIG. 5 is a graph of the density normalized yield stress versus temperature for the three alloys of the present invention of a T6 temper, a standard aluminum alloy, a mill annealed Ti-6Al-4V titanium alloy, and a solution treated and aged T-6Al-4V titanium alloy after a hundred hour exposure.
Figure 6:
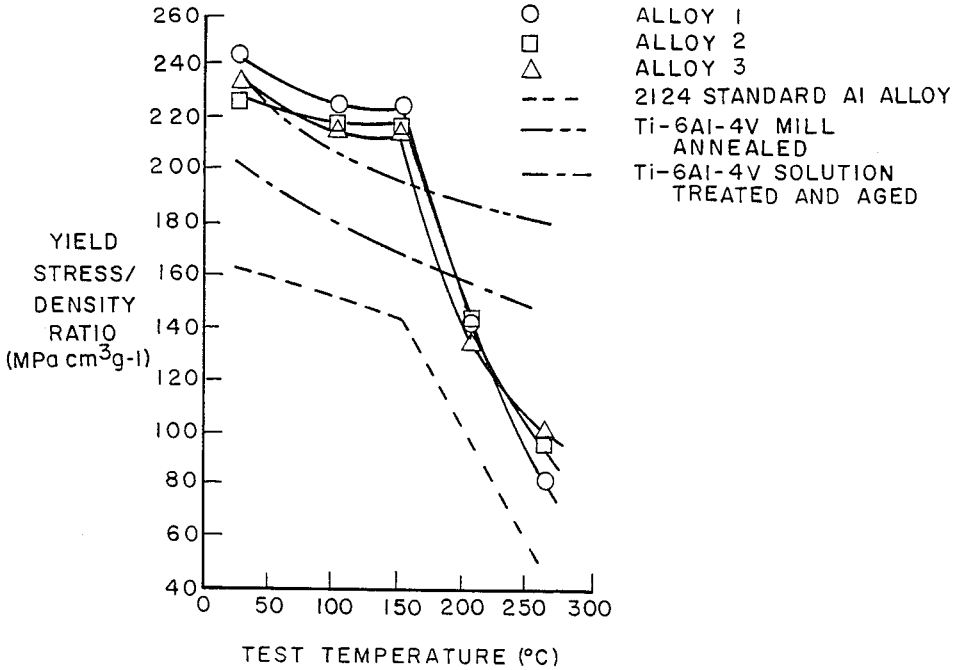
FIG. 6 is a graph of the density normalized yield stress versus temperature for the three alloys of the present invention of a T8 temper, a standard aluminum alloy, a mill annealed Ti-6Al-4V titanium alloy, and a solution treated and aged T-6Al-4V titanium alloy after a hundred hour exposure.

Referring now to FIGS. 5 and 6, the yield stress/density ratio versus temperature for the three alloys and a standard 2124 aluminum alloy are shown. Also shown are data for both a mill annealed specimen and a solution treated and aged specimen of titanium alloy consisting of 6 wt % Al and 4 wt % vanadium. Each datum point was obtained after exposure of a sample to a particular temperature for 100 hours. The three alloys of the present invention have higher yield stress/density ratios than the standard aluminum alloy for the entire range of temperatures from 25° C. to 260° C. Also, the three alloys of the present invention have a higher yield stress/density ratio than both specimens for the Ti-6Al-4V alloy from 25° C. to 150° C.

Accordingly, the three alloys of the present invention have a desirable combination of low density and high strength for temperatures ranging from 25° C. to 260° C. for periods up to 100 hours. Thus, the present invention may be utilized in high performance aircraft structures and engines requiring elevated temperature service of 260° C.

Structural members in high-performance aircraft such as supersonic fighters, bombers, and transports must be able to withstand temperatures of at least 150° C. for extended times without a loss in properties. The three alloys of the present invention are suitable substitutes from heavier conventional titanium alloys and weaker conventional aluminum alloys in these applications. Also, engine-heated structures in high-performance aircraft which are normally constructed from conventional titanium alloys may be constructed with the three alloys of the present invention to obtain adequate elevated temperature performance of up to 260° C. with significant structural weight savings.

What is claimed is:

1. An aluminum based alloy consisting essentially of in weight percent:

| | |
|---|---|
| Copper | 3.0 |
| Lithium | 2.0 |
| Magnesium | 1.0 |
| Zirconium | 0.2 |
| Iron | 1.0 |
| Nickel | 1.0 |
| Aluminum | Balance (except for incidental impurities) |

which is produced by inert gas atomization at solidification rates in excess of $10^{3}$ ° K./S.

2. An aluminum based alloy consisting essentially of in weight percent;

| | |
|---|---|
| Copper | 3.0 |
| Lithium | 2.0 |
| Magnesium | 1.0 |
| Zirconium | 0.2 |
| Chromium | 1.6 |
| Aluminum | Balance (except for incidental impurities) |

which is produced by inert gas atomization at solidification rates on excess of $10^{3}$ ° K./S.

3. A high performance aircraft structure requiring elevated temperature service of 260° C. formed from an aluminum alloy according to claim 2.

4. A high performance aircraft structure requiring elevated temperature service of 260° C. formed from an aluminum alloy according to claim 3.

5. A high performance aircraft engine component requiring elevated temperature service of 260° C. formed from an aluminum alloy according to claim 2.

6. A high performance aircraft engine component requiring elevated temperature service of 260° C. formed from an aluminum alloy according to claim 3.

* * * * *